US009936808B2

(12) United States Patent
Iacovoni et al.

(10) Patent No.: US 9,936,808 B2
(45) Date of Patent: Apr. 10, 2018

(54) ARTICLE OF FURNITURE WITH MODULAR CONSTRUCTION

(71) Applicant: Steelcase Inc., Grand Rapids, MI (US)

(72) Inventors: Joseph Iacovoni, Caledonia, MI (US); Alan Rheault, Grand Rapids, MI (US); Mark Kapka, San Francisco, CA (US); Karl Mead, East Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 79 days.

(21) Appl. No.: 14/584,258

(22) Filed: Dec. 29, 2014

(65) Prior Publication Data

US 2015/0145389 A1 May 28, 2015

Related U.S. Application Data

(63) Continuation of application No. 13/599,379, filed on Aug. 30, 2012, now Pat. No. 8,950,817.

(51) Int. Cl.

| | |
|---|---|
| ***A47B 83/00*** | (2006.01) |
| ***A47B 83/02*** | (2006.01) |
| ***A47B 13/02*** | (2006.01) |
| ***A47C 13/00*** | (2006.01) |

(52) U.S. Cl.

CPC ..... *A47B 83/001* (2013.01); *A47B 13/021* (2013.01); *A47B 83/02* (2013.01); *A47C 13/005* (2013.01)

(58) Field of Classification Search

CPC .. A47C 13/005; A47C 4/02; E04B 2002/7483

USPC ..... 297/257, 232, 157.1, 163, 174 R, 135, 297/452.18

See application file for complete search history.

(56) References Cited

U.S. PATENT DOCUMENTS

| | | | |
|---|---|---|---|
| 18,375 | A | 10/1857 | Bailey |
| 56,986 | A | 8/1866 | Onnenheimer |
| 91,002 | A | 6/1869 | Engelmonn |
| 110,013 | A | 12/1870 | Congle |
| 198,922 | A | 1/1878 | June |
| 213,549 | A | 3/1879 | Deah |
| 245,516 | A | 8/1881 | Langston |
| 257,343 | A | 5/1882 | Knauss |
| 277,272 | A | 12/1882 | Hale |

(Continued)

FOREIGN PATENT DOCUMENTS

| | | |
|---|---|---|
| EP | 100491 B1 | 10/1986 |
| EP | 627562 A1 | 12/1994 |

*Primary Examiner* — Sarah B McPartlin

(57) ABSTRACT

An article of furniture is disclosed. The article of furniture comprises a base frame assembly configured to support an attached seating unit. Other modules or components may also be attached to the base frame assembly. The article of furniture may also comprise a supplemental frame assembly attached to the base frame assembly to extend the size of the article of furniture and to support an additional or larger module or component. The other modules or components may comprise one or more of a casegood unit, a backrest, an armrest, a privacy panel, a console, an outlet (for power and/or data), etc. Electronic devices may be incorporated. A set of articles of furniture is also disclosed; the articles of furniture have a modular construction and can be assembled on the base frame assembly by combinations of modules and components.

19 Claims, 14 Drawing Sheets

(56) References Cited

U.S. PATENT DOCUMENTS 288,126 A 11/1883 Shearman
306,362 A 10/1884 Stewart
311,854 A 2/1885 Roush
434,174 A 8/1890 Bryant
434,229 A 8/1890 Arnold
471,077 A 3/1892 Dexter
473,151 A 4/1892 Good et al.
494,547 A 12/1892 Buel
495,857 A 4/1893 Voltz
704,702 A 7/1902 Jones
877,716 A 1/1908 Jones
915,002 A 3/1909 Werner
920,509 A 5/1909 Werner
952,090 A 12/1909 Zdzieblowski
946,423 A 1/1910 Connaty
971,342 A 9/1910 Balentine
984,387 A 2/1911 Orr
1,041,549 A 12/1911 Winton et al.
1,036,813 A 8/1912 Edsall et al.
1,240,390 A 12/1916 Uhl
1,246,028 A 12/1916 Kleckler
1,249,416 A 12/1917 Kapelman
1,269,691 A 6/1918 Dyke
1,419,957 A 6/1922 Cobb
1,630,492 A 5/1927 Kusterle
1,695,101 A 12/1928 Hoffman
1,726,291 A 8/1929 Fox
1,741,051 A 12/1929 Ford
1,764,037 A 6/1930 Brunner
1,990,046 A 2/1935 Mayrose
2,270,656 A 1/1942 Kiesecker
2,305,183 A 12/1942 Otto
2,423,798 A 7/1947 Sabner
2,466,204 A 4/1949 Brown
2,480,559 A 8/1949 Derse, Sr.
2,485,172 A 10/1949 Roy et al.
2,560,877 A 7/1951 Kurtzon
2,639,956 A 5/1953 Jacobson
2,715,468 A 8/1955 Waltz
2,743,980 A 5/1956 Frank
2,744,590 A 5/1956 Butts
2,793,685 A 5/1957 Spitz
2,802,242 A 8/1957 Synder
2,845,112 A 7/1958 Martin
2,915,350 A 12/1959 Sinclair
2,925,851 A 2/1960 Weiss
2,927,328 A 3/1960 Rudolph
2,994,905 A 8/1961 Franker, Jr.
3,018,526 A 1/1962 Riebel
3,074,762 A 1/1963 Samuel
3,093,410 A 6/1963 Wilson
3,093,838 A 6/1963 Beasley
3,098,243 A 7/1963 Roche
3,137,890 A 6/1964 Kochanowski
3,183,036 A 5/1965 Hill
3,188,137 A 6/1965 Sarvas
3,241,885 A 3/1966 Deaton
3,265,342 A 8/1966 Brettner
3,299,840 A 1/1967 Schultz
3,316,018 A 4/1967 Stith
3,328,075 A 6/1967 Albinson
3,380,777 A 4/1968 Bennett
3,464,568 A 9/1969 Hexter
3,563,599 A 2/1971 Heumann
3,572,787 A 3/1971 Timmerman et al.
3,584,916 A 6/1971 Bayes
3,590,753 A 7/1971 Blink et al.
3,614,156 A 10/1971 Sarvas
3,640,576 A 2/1972 Morrison et al.
3,645,569 A 2/1972 Reilly
3,658,381 A 4/1972 Grant, Sr.
3,658,382 A 4/1972 Anderson
3,676,974 A 7/1972 Daly
3,727,981 A 4/1973 Ostroff et al.
3,748,012 A 7/1973 Abelman
3,748,799 A 7/1973 Tough et al.
3,756,657 A 9/1973 Johnson
3,811,728 A * 5/1974 Redemske ..... A47B 83/00 297/440.14
3,817,573 A 6/1974 Facury
3,857,120 A 12/1974 Acker
3,912,210 A 10/1975 von Bohr
3,957,239 A 5/1976 Slaats et al.
3,973,800 A 8/1976 Kogan
3,986,316 A 10/1976 Blodee
4,043,591 A 8/1977 Lehmann
4,065,818 A 1/1978 Farina
4,066,370 A 1/1978 Van Driessche
4,077,666 A 3/1978 Heumann
4,107,897 A 8/1978 Ullman, Jr.
4,124,251 A 11/1978 Petersen
4,242,969 A 1/1981 Checkwood et al.
4,303,289 A 12/1981 Hardy
4,305,616 A 12/1981 Martinez
4,409,906 A 10/1983 Alneng
4,503,780 A 3/1985 Apissomian
4,523,787 A 6/1985 Robinson
4,549,711 A 10/1985 Giltnane
4,580,841 A 4/1986 Raftery
4,606,170 A 8/1986 Mendenhall
4,621,471 A 11/1986 Kuhr et al.
4,639,042 A 1/1987 Lange
4,642,957 A 2/1987 Edwards
4,657,302 A 4/1987 Snyder
4,691,965 A 9/1987 Hsiung
4,727,816 A 3/1988 Virtue
4,771,574 A 9/1988 Stephens
4,845,915 A 7/1989 Rogers et al.
4,850,646 A 7/1989 Wieland
4,886,297 A 12/1989 Levine
4,893,958 A 1/1990 Wieland
4,904,022 A 2/1990 Morozzi
4,932,720 A 6/1990 Sherman
4,973,187 A 11/1990 Sauder
5,000,512 A 3/1991 Laird
5,035,186 A 7/1991 Uredat et al.
5,074,754 A 12/1991 Violette
5,112,110 A 5/1992 Perkins
5,163,373 A 11/1992 Anderson et al.
5,197,642 A 3/1993 Cortelli
5,233,707 A 8/1993 Perkins
5,265,939 A 11/1993 Self et al.
5,277,476 A 1/1994 Caldwell
5,306,072 A 4/1994 Caldwell
5,341,749 A 8/1994 Noakes
5,423,597 A 6/1995 Rogers
5,440,857 A 8/1995 Shanok et al.
5,472,256 A 12/1995 Tucker
5,555,688 A 9/1996 Logan
5,577,451 A 11/1996 Yeh
5,601,340 A 2/1997 Stout
5,720,457 A 2/1998 Miller et al.
5,738,414 A 4/1998 Wieland et al.
5,740,568 A 4/1998 Elliott
5,803,647 A 9/1998 Hughes
5,870,868 A 2/1999 Kita et al.
5,957,418 A 9/1999 Nelson
5,957,437 A 9/1999 Savenok
5,984,417 A 11/1999 Wang
5,988,077 A 11/1999 Balderi
6,106,186 A 8/2000 Taipale et al.
6,171,013 B1 1/2001 Lee
6,241,317 B1 6/2001 Wu
6,279,997 B1 8/2001 Moore et al.
6,279,998 B1 8/2001 Chu et al.
6,318,672 B1 11/2001 Traylor
6,367,880 B1 4/2002 Niederman et al.
6,688,699 B1 2/2004 Bowie
6,692,079 B2 2/2004 Guillot
6,702,389 B2 3/2004 Hall, Jr. et al.
6,715,837 B2 4/2004 Niederman et al.
6,752,364 B1 6/2004 Lim
6,758,450 B2 7/2004 Niederman et al.
6,776,380 B1 8/2004 Kirk, Jr. et al.

(56) References Cited

U.S. PATENT DOCUMENTS

| | | | | |
|---|---|---|---|---|
| 6,783,182 | B1 | 8/2004 | Gallagher | |
| 6,796,614 | B1 | 9/2004 | Paul | |
| 6,827,407 | B2 | 12/2004 | Niederrnan et al. | |
| 6,948,199 | B2 | 9/2005 | Hooper, Jr. | |
| 7,020,911 | B2 | 4/2006 | Oldham | |
| 7,125,002 | B2 | 10/2006 | Platt | |
| 7,210,272 | B2 | 5/2007 | Friday | |
| 7,255,511 | B2 | 8/2007 | Dolan | |
| 7,419,220 | B2 | 9/2008 | White et al. | |
| 7,431,976 | B2 | 10/2008 | Hermann et al. | |
| 7,480,947 | B2 | 1/2009 | Patella | |
| 7,575,283 | B2 | 8/2009 | Crowe | |
| 7,677,830 | B1 | 3/2010 | Brown | |
| 7,708,345 | B2 | 5/2010 | Grabowski et al. | |
| 7,744,161 | B2 | 6/2010 | Berg et al. | |
| 7,744,162 | B2 | 6/2010 | Griggs, Jr. | |
| 7,922,253 | B2 | 4/2011 | Chen | |
| 7,942,100 | B2 | 5/2011 | Grove et al. | |
| 7,963,612 | B2 | 6/2011 | Nelson | |
| 7,988,236 | B2 | 8/2011 | Brandtner | |
| 8,322,793 | B2 | 12/2012 | Chen | |
| 8,696,067 | B2 | 4/2014 | Galbreath et al. | |
| D714,068 | S * | 9/2014 | Kapka | D6/337 |
| 2002/0106240 | A1 | 8/2002 | Johnson | |
| 2002/0122691 | A1 | 9/2002 | Wood | |
| 2003/0015421 | A1 | 1/2003 | Cha et al. | |
| 2005/0275252 | A1 * | 12/2005 | Barrett | A47B 83/02 297/162 |
| 2007/0063112 | A1 | 3/2007 | Patterson | |
| 2008/0136244 | A1 | 6/2008 | Cheng | |
| 2009/0284111 | A1 | 11/2009 | Hazzard et al. | |
| 2010/0264715 | A1 | 10/2010 | Griggs, Jr. | |
| 2011/0101763 | A1 | 5/2011 | Chen | |
| 2011/0101836 | A1 | 5/2011 | Gamble et al. | |

* cited by examiner

ARTICLE OF FURNITURE WITH MODULAR CONSTRUCTION

CROSS-REFERENCE TO RELATED APPLICATIONS

This application is a continuation of U.S. patent application Ser. No. 13/599,379 filed on Aug. 30, 2012, the entire disclosure of which is hereby incorporated herein by reference.

BACKGROUND OF THE INVENTION

The present invention relates to an article of furniture having a modular construction. The present invention also relates to an article of furniture having a base and modules or components supported on the base. The present invention further relates to a set of articles of furniture constructed from modules or components and configured for use in a work environment.

Articles of furniture for use in a work environment are constructed from one or more components. For example, a chair may typically provide a seating surface, a seating surface and a backrest, a seating surface and an armrest, a seating surface and a worksurface, a seating surface with an armrest and a backrest. Lounge seating may provide a seating surface and a backrest, a seating surface and an armrest, etc. Such known articles of furniture are typically constructed in a "fixed" form such that components are not interchangeable between multiple articles of furniture.

Furniture having a modular construction assembled from components or modules is known. Such modular furniture may provide for some degree of interchangeability of modules and components but may nonetheless be limited in the variety and types of modules or components that may be combined; such modular furniture may also subject to limitations as to structural rigidity and aesthetic appearance.

BRIEF SUMMARY OF THE INVENTION

It would be advantageous to provide for an article of furniture having a modular construction that was configured to provide a relatively wide range of options for modules and components including seating units and casegoods units and that includes a base on which a relatively wide variety of modules and components could be installed to present a consistent and aesthetically pleasing appearance.

The present invention relates to an article of furniture having a modular construction comprising a base with a frame structure, a seating component supported on the frame structure of the base and a casegood component supported on the frame structure of the base. The frame structure of the base is configured to support at least one additional modular component selected from a seating unit, a backrest, an armrest, a console, a tray, a worksurface, a table, a panel, an outlet for power, an outlet for data, an electronic device.

The present invention also relates to an article of furniture having a modular construction comprising a base with a frame structure and at least one leg assembly. The base is configured to support at least three modular components. The modular components comprise a seating component, a casegood component and at least one additional modular component selected from a seating unit, a backrest, an armrest, a console, a tray, a worksurface, a panel, an outlet for power, an outlet for data, an electronic device. The base is configured for attachment of a supplemental frame to support at least one additional modular component.

The present invention further relates to an article of furniture comprising a base including a frame structure and at least three components attached to the base and supported by the base. The base comprises at least two leg assemblies and at least two trim members secured to a leg assembly. The components comprise a seating unit and at least two other components selected from a group comprising a seating unit, a casegoods unit, a backrest, an armrest, a wide armrest, a narrow armrest, a console, a tray, a table, a privacy panel, a tray, an outlet for power, an outlet for data, an electronic device, a worksurface, a wall. Each trim member has an internal cavity and each leg assembly comprises a member configured to fit within the cavity of the trim member to attach the trim member to the leg assembly and to the base.

DESCRIPTION

Figure 1A:
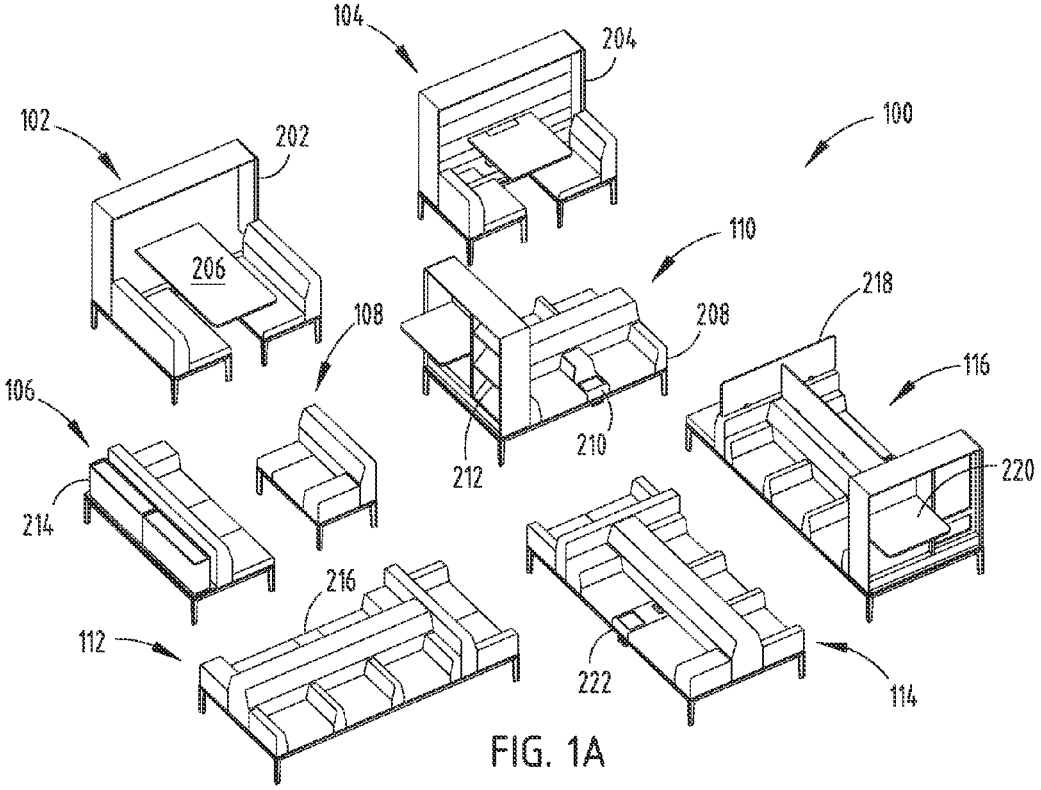
FIG. 1A is a front perspective view of a set of articles of furniture according to an exemplary embodiment of the present inventions.
Figure 1B:
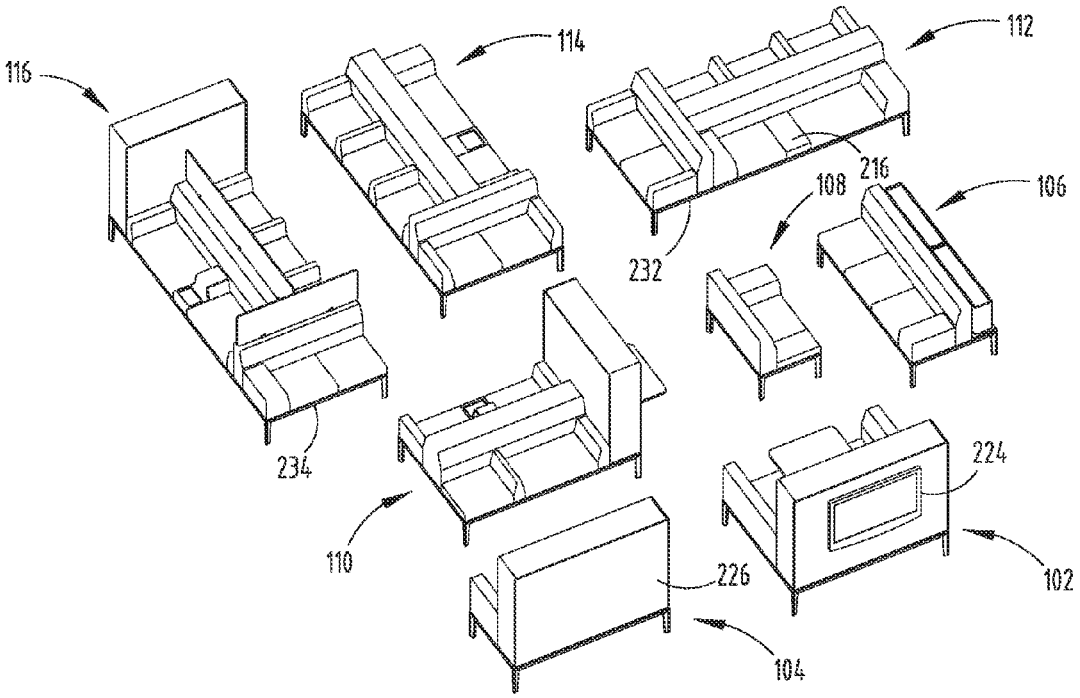
FIG. 1B is a rear perspective view the set of articles of furniture shown in FIG. 1.

Referring to FIGS. 1A and 1B, a set or collection of articles of furniture 100 is shown according to exemplary embodiments. The articles of furniture have a generally modular form and provide a seat or seating unit integrated with other modules and components (e.g. units) supported on a base frame assembly or base providing legs that rest upon a floor or surface. As shown, according to any exemplary embodiment, the modules and/or components of an article may comprise one or more of a seat or seating unit (e.g. with seat cushions of various configurations), a backrest (provided in different types and thicknesses), a worksurface or table, an armrests (provided in different sizes and configurations), a visual/privacy panel, a case or casegoods (e.g. casegood unit providing for storage or display of items, a shelving unit, a counter or countertop), a console, a tray, a table (e.g. surface, inlaid panel/veneer), a console-tray, an armrest-tray, an outlet for data and power connectivity (such as AC power, network connection, USB connection, etc.), an electronic device (e.g. such as a display panel, audio and/or audio-visual system, etc.), a wall or panel wall, etc. According to exemplary embodiments, the modules and/or components may be provided in various combinations; the modules and components may be resized or provided in various other sizes and forms (e.g. representative of the embodiments shown in the FIGURES). According to an exemplary embodiment, the articles of furniture are configured and/or arranged for use in a work environment (e.g. an office, health-care/patient-care facility, commercial facility, retail operation, hospitality venue, educational facility, etc.).

The articles of furniture 100 may comprise a wide variety of modules and components of different forms, types and functions. Article 102 comprises two seating units and a case shown as casegood unit 202 providing a worksurface shown as a table 206; an electronic device shown as flat-panel display 224 is supported on the back of case 202. However, the flat-panel display 224 can alternatively be mounted inside of a case such as that shown in article 116. Article 104 comprises two seating units and a case shown as casegood unit 204 providing a worksurface shown as a table; the back of case 202 presents a wall 226. Article 106 comprises a bench seat with a single armrest and a backrest abutting a case shown as casegood unit 214 providing a countertop (e.g. structure which may function as a shelf and/or with accompanying storage or be configured as a planter, etc.). Article 108 comprises a seat with a single armrest and a backrest. Article 110 comprises two seating units with a shared backrest and an armrest/tray 210 as well as a case shown as a casegood unit providing a worksurface or table and a shelving section 212.

Article 112 comprises three seating units; two of the seating units share a backrest; one of the seating units 232 comprises a surface shown as table 216 (e.g. a surface which may provide support for objects and/or present a decorative/ornamental appearance such as provided by a inlaid panel or veneer) between the seat cushions; the third seating unit is transverse to the other two seating units and at one end of the article. Article 114 comprises three seating units; two of the seating units share a backrest; one of the seating units comprises a console/tray (which may provide an outlet for power or data connectivity); the third seating unit 234 is transverse to the other two seating units and at one end of the article. Article 116 comprises three seating units and a case shown as casegoods unit 220; two of the seating units have a backrest with a privacy panel 218 (e.g. a vertical panel shown as having a translucent form, but which may be provided in other forms such as a slat/slotted wall and or opaque panel); two of the seating units share a backrest; one of the seating units is transverse to the other two seating units (and parallel to the casegoods unit); one seating unit is at one end and the casegood unit is at the other end.

As shown in FIGS. 1A and 1B, in comparison of article 106 and article 116, a casegood unit may be installed on the base in multiple orientations, for example, in alignment with a seating unit or transverse to a seating unit. According to other exemplary embodiments, an article of furniture may be provided with two or more casegood units and/or two or more seating units (with varying orientation).

According to any preferred embodiment, as shown in FIGS. 1A and 1B, the configuration, form and size of individual articles of furniture may be adapted for one or more purposes in the work environment; combinations of individual articles of furniture may also be configured and arranged for one or more purposes in the work environment. As shown in FIGS. 1A and 1B, by various combinations and arrangements of modules and components, articles of furniture of varying uses, functions and/or appearances may be constructed. Other items and/or peripherals may be attached to or associated with the articles of furniture (e.g. electronic devices such as display panels); the article of furniture may be provided with other attachable components above and below the platform of the base frame (e.g. outlets for power and/or data). Further, the article of furniture may be provided with wire and cable management devices attached to the base frame.

According to any exemplary embodiment, a casegood unit (e.g. as a component or module) may be provided in any of a variety of forms and may serve any of a variety of purposes or functions (or combinations of purposes and functions), such as enclosed storage/cabinetry, open storage/shelving, file storage, work surface/table, countertop, electronic/computing technology access or concealment, wall space, mounting of displays, information/other display, privacy or visual/sound screen, utensils and appliances, keeping foodstuffs/refreshments and services, access to informational/hospitality items, art display, planter box, aesthetic/ornamental effects, etc. According to any exemplary embodiment, the structure, shape and size of a case or casegood unit (e.g. height, depth, width and form) as well as the configuration may be adapted or constructed for particular purposes as intended for the article of furniture. Also, backs of casegood units can be removed to allow access to power and other cables for ease in installation of display units and other powered devices. In an exemplary embodiment, the casegood unit comprises two parallel backs which form a compartment in which to hide power and other cables from view.

Figure 2A:
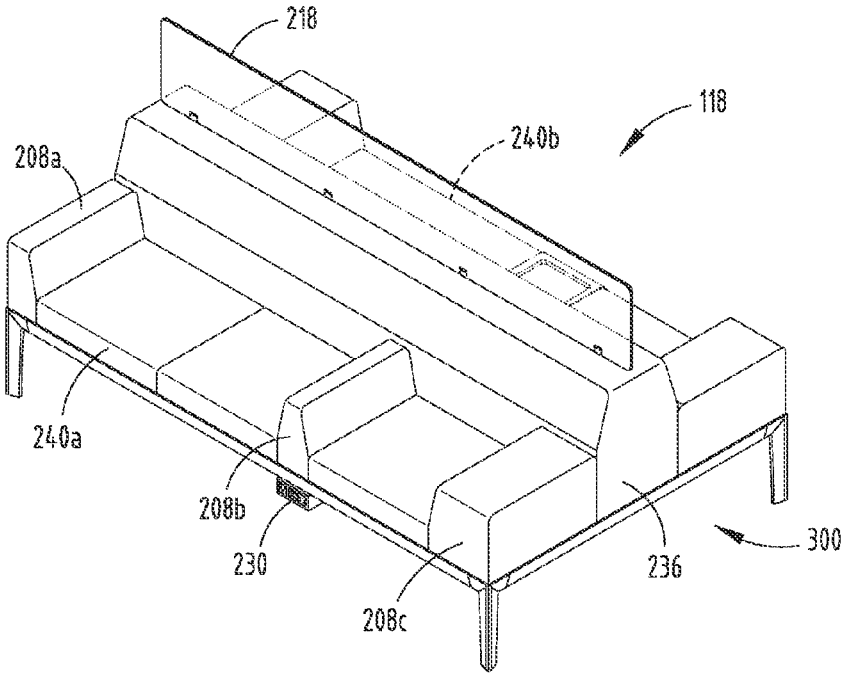
FIG. 2A is a perspective view of an article of furniture according to an exemplary embodiment.
Figure 2B:
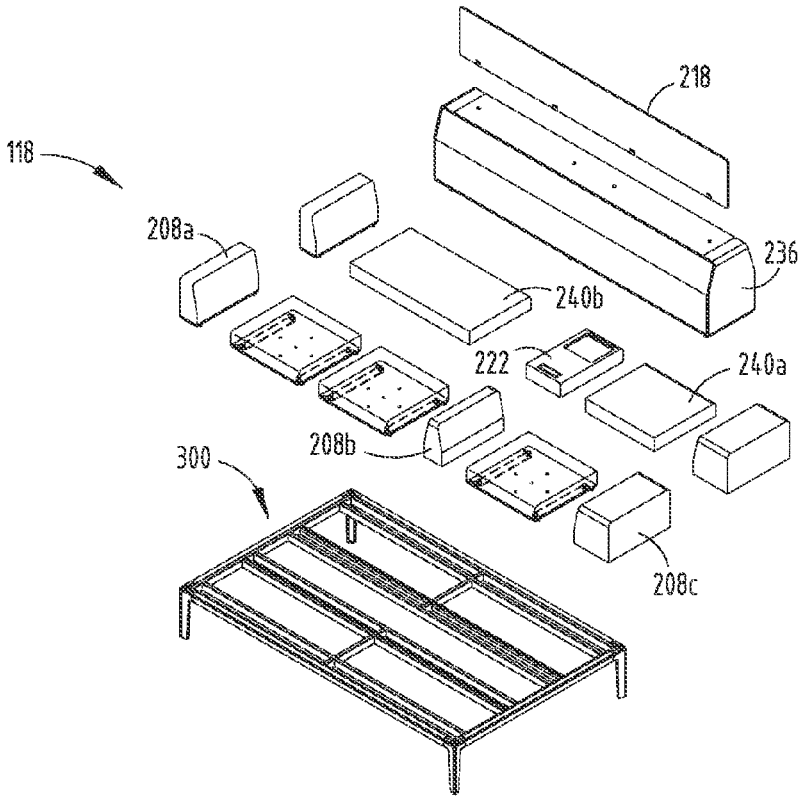
FIG. 2B is a partially exploded perspective view of the article of furniture shown in FIG. 2A.

Referring to FIGS. 2A and 2B, an article of furniture 118 is shown according to an exemplary embodiment. Article 118 comprises a base 300 with seating units providing seating surfaces (shown as seat cushions 240*a* and 240*b*); article 118 also comprises other modules and components (shown as armrests 208*a* and 208*b* and 208*c*, a backrest 236 with a privacy panel 218 and a console/tray 222). As shown, the seating units and other modules/components of the article of furniture are supported on (and attached to) the base. An outlet 230 providing power and data connectivity is also provided on the base (e.g. mounted to the frame structure of the base under the seating units and other modules/components).

As shown in FIGS. 2A through 5, base 300 comprises a frame structure 302 and leg assemblies 306 forming a support structure. Frame structure 302 comprises inner frame members 310 and 312 and outer frame members 318*a* and 318*b*; inner frame members 310 serve as beams and attached inner frame members 312 serve as cross members for the frame structure. The inner frame members are attached to the outer frame members (e.g. by welding or mechanical fasteners) to form a frame structure capable of supporting the load of modules and components. The support structure comprises at least two leg assemblies 306 to elevate and support the frame structure 302 above the floor. According to an exemplary embodiment, frame structure 302 is attached at corners to leg assemblies 306 by fasteners shown as pins 314 of a clevis arrangement 315 to form a suitable load-bearing structure for base 300.

Figure 3A:
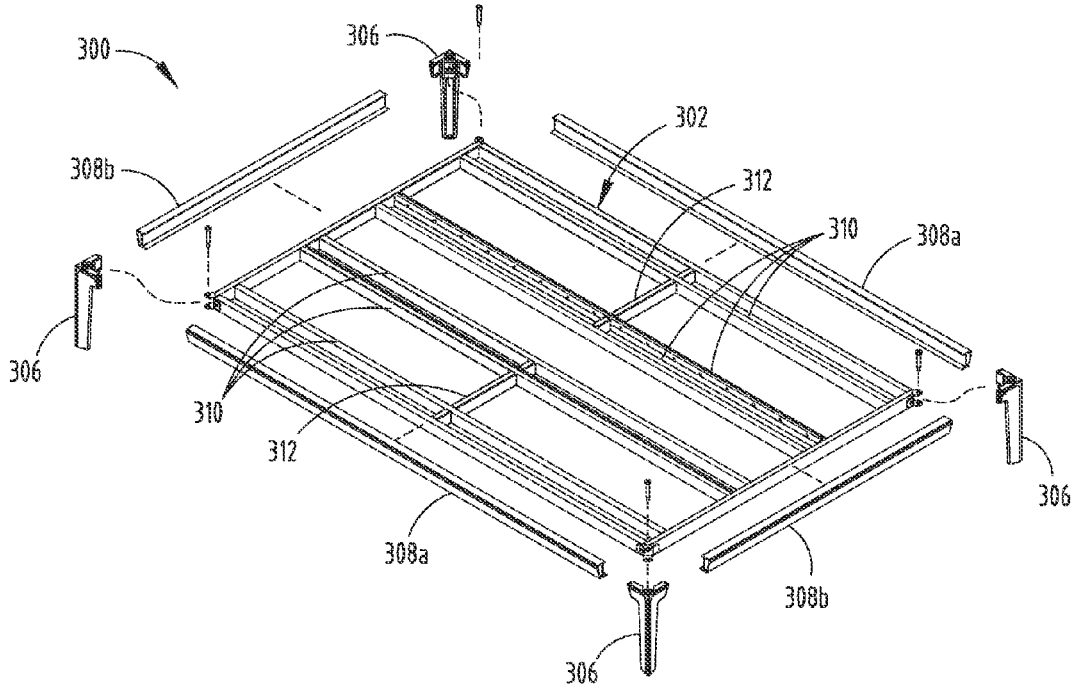
FIG. 3A is a partially exploded perspective view of a base frame assembly of an article of furniture according to an exemplary embodiment, where the base frame assembly is shown without modules or components for clarity.
Figure 3B:
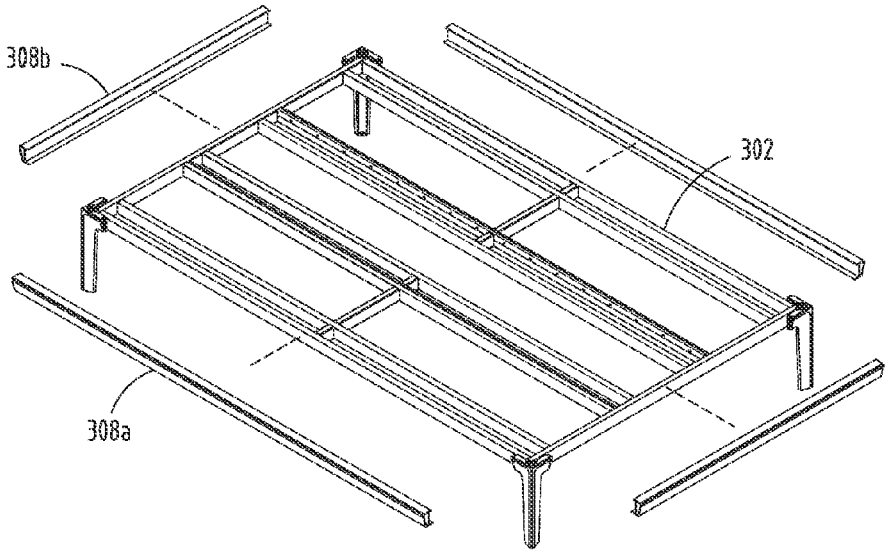
FIG. 3B is a perspective view of the base frame assembly shown in FIG. 3A with the frame structure attached to the leg assemblies.
Figure 4:
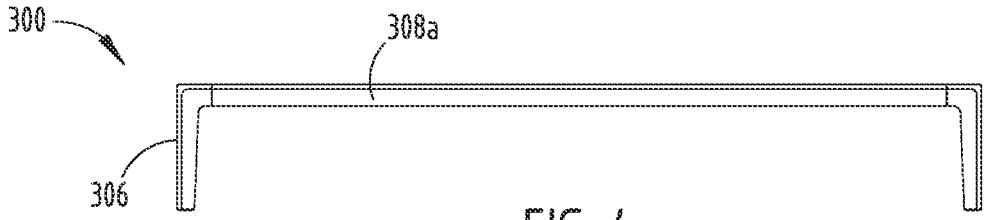
FIG. 4 is a side elevation view of the base frame assembly according to an exemplary embodiment, where the base frame assembly is shown without modules or components for clarity.
Figure 5:
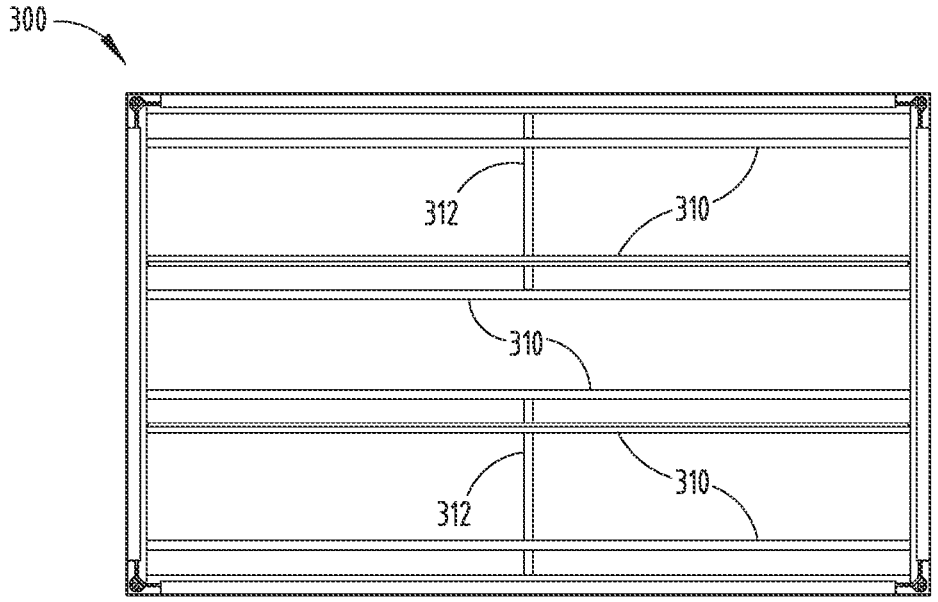
FIG. 5 is a top plan view of the base frame assembly shown in FIG. 4, where the base frame assembly is shown without modules or components for clarity.
Figure 6A:
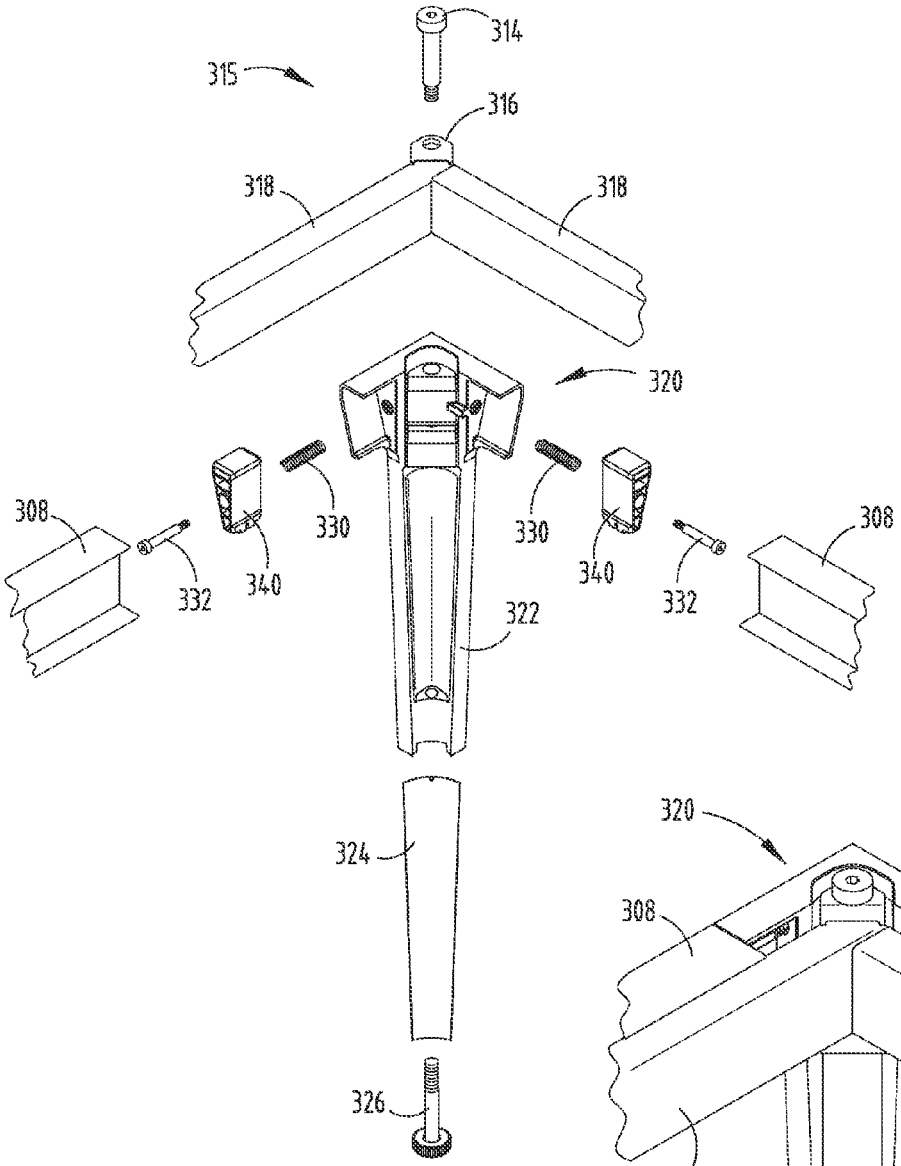
FIG. 6A is an exploded perspective view of the attachment of a leg assembly of the base frame assembly according to an exemplary embodiment.
Figure 6B:
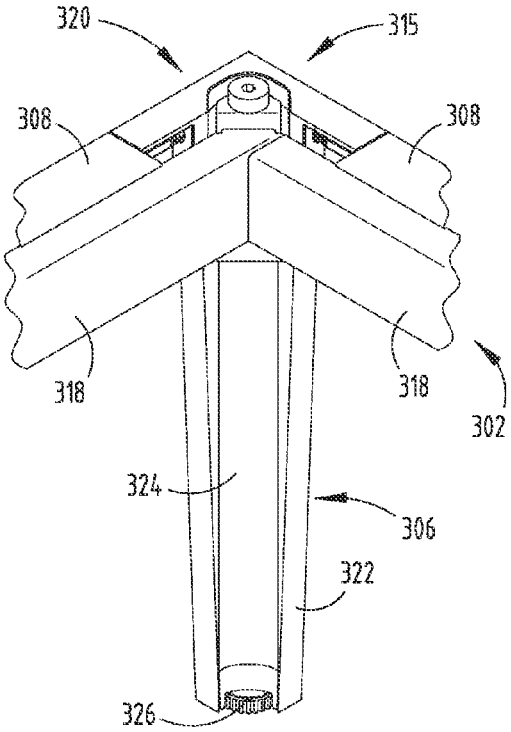
FIG. 6B is a perspective view of the attachment of the leg assembly shown in FIG. 6A.
Figure 7A:
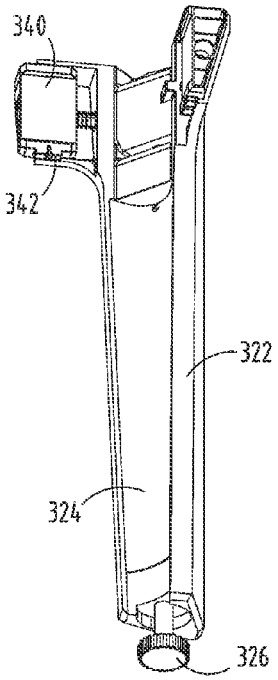
FIG. 7A is a perspective view of a leg assembly of the base frame assembly according to an exemplary embodiment.
Figure 7B:
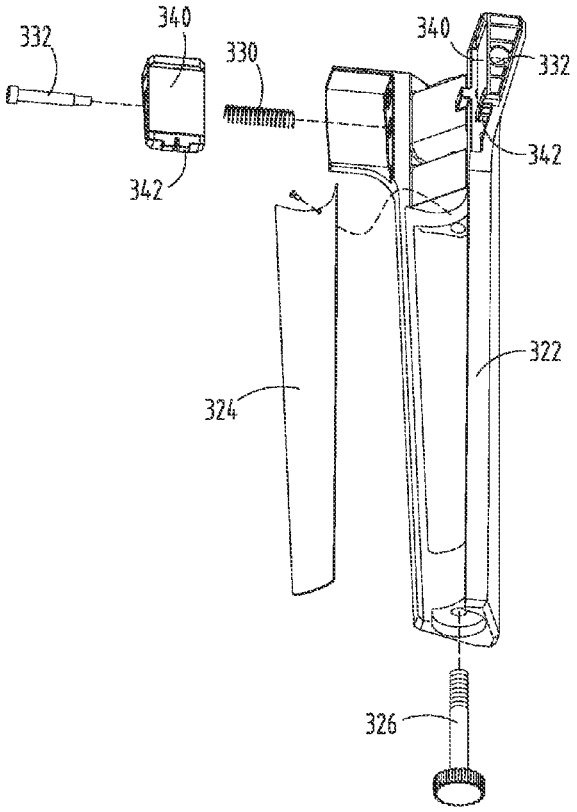
FIG. 7B is a partially exploded perspective view of the leg assembly of FIG. 7A.

Referring to FIGS. 3A, 3B and 4, trim members 308*a* and 308*b* are attachable to the base at the leg assemblies 306. According to an exemplary embodiment, the trim members serve multiple functions for the article of furniture, including to provide an aesthetic/ornamental appearance for the article of furniture and to secure modules or components to the base; the trim members when installed may also provide a degree of structural rigidification for the support structure and base frame assembly. According to a preferred embodiment, during the construction of an article of furniture, in sequence the trim members will be attached to the base after the modules or components have been set into place on the base; the trim members are configured so that attachment of the trim members secures and holds certain types of modules and components to the base. (It should be noted that for clarity in certain of the FIGURES, such as FIGS. 2B and 4, the base may be shown with the trim members attached but without modules or components attached so that the attachment of trim members to the base is depicted clearly without obstruction by the modules or components.)

According to an exemplary embodiment, the members of the frame structure of the base are steel tubes that may be attached to form the frame structure by welding or other suitably secure mechanical fasteners; the trim members attachable to the base may be formed as an extrusion (e.g. of a rigid plastic or metal material) configured for attachment to the leg assemblies. As shown in FIGS. 2A and 4, trim members 308*a* and 308*b* and leg assemblies 306 provide readily visible exterior surfaces of base 300 and may be designed and configured to present a desired aesthetic appearance for the article of furniture.

The members of the frame structure are configured to provide attachment areas for the modules and components (e.g. on and in between members 310 and 312). As shown, according to an exemplary embodiment, in the formation and construction of the article of furniture, the frame structure is attached to the support structure (e.g. leg assemblies) to form the base; and modules or components are installed and supported on the base (e.g. on the frame structure); then trim members are attached to the base to secure certain of the modules and components to the base.

Referring to FIGS. 6A-6B, 7A-7B and 8A-8B, the configuration of a leg assembly 306 of base 300 is shown according to an exemplary embodiment. Leg assembly 306 comprises a base 320, a pair of members shown as plungers or blocks 340 installed (partially/movably) within base 320. Members or plunger blocks 340 are attached to base 320 by a spring-loaded bolt arrangement comprising springs 330 and bolts 332. Leg assembly 306 also comprises a post 322 providing a support structure with an adjustable foot 326 and an attachable cover or trim piece 324; according to an exemplary embodiment, foot 326 is threadably installed within post 322 to provide a height-adjustment mechanism for each leg assembly 306 for leveling the article of furniture.

Figure 9A:
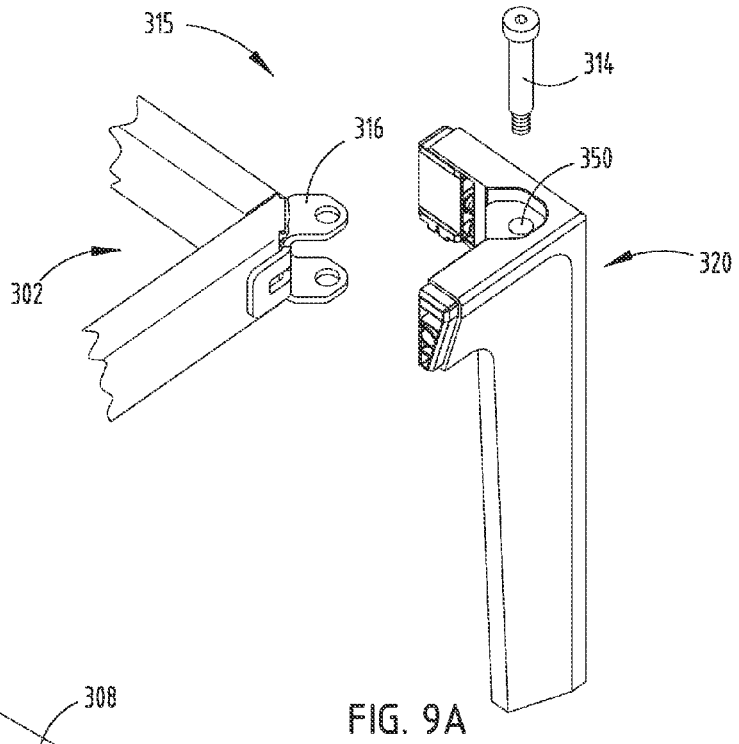
FIG. 9A is a partially exploded top perspective view of the attachment of the frame structure to the leg assembly of the base frame assembly according to an exemplary embodiment.
Figure 9B:
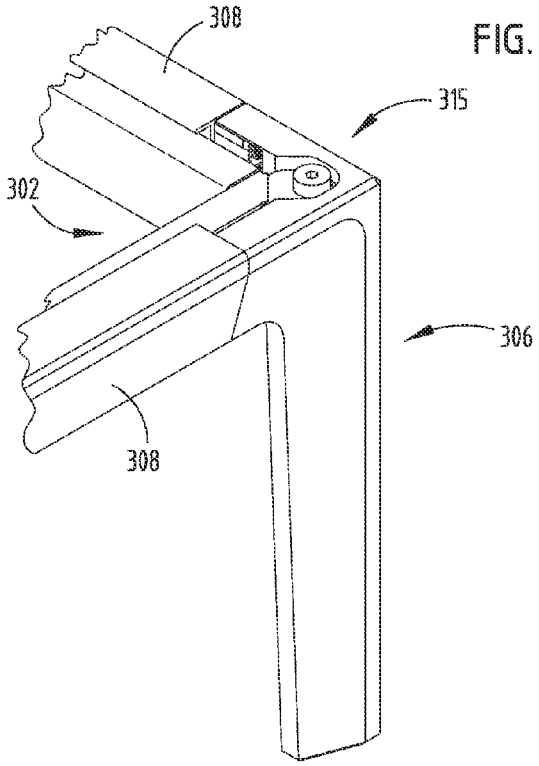
FIG. 9B is a perspective view of the attachment of the frame structure to the leg assembly shown in FIG. 9A.
Figure 10:
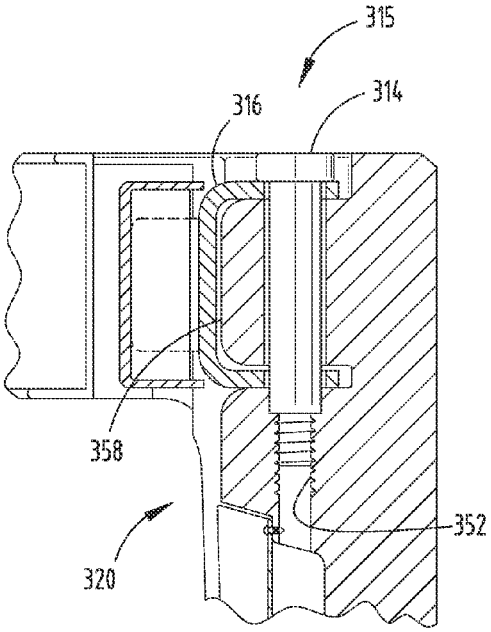
FIG. 10 is a cross-sectional side view of the attachment of the frame structure to the leg assembly of the base frame assembly according to an exemplary embodiment.
Figure 11:
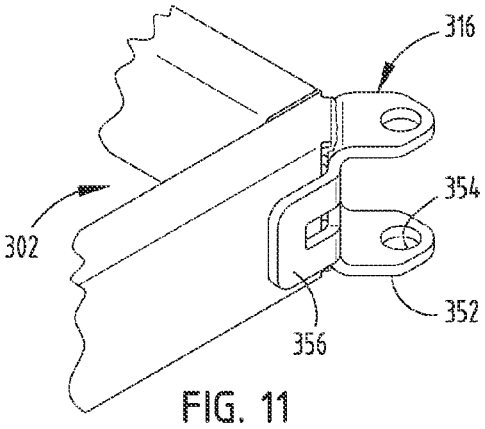
FIG. 11 is a side perspective view of a clevis bracket attached to the frame structure of the base frame assembly according to an exemplary embodiment.
Figure 12:
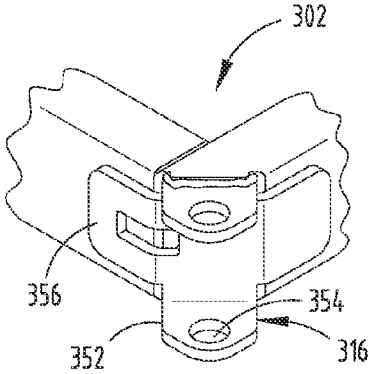
FIG. 12 is a front perspective view of the clevis bracket shown in FIG. 11.
Figure 13:
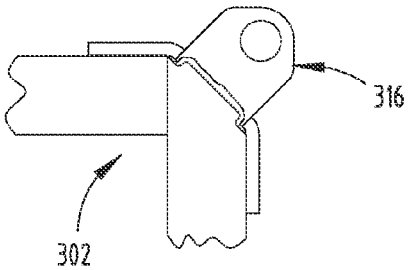
FIG. 13 is a top plan view of the clevis bracket shown in FIG. 11.
Figure 14:
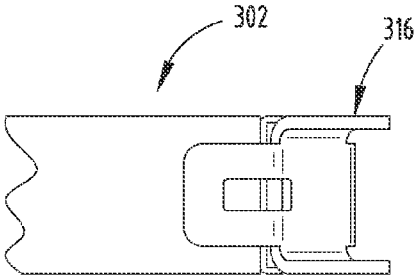
FIG. 14 is a side elevation view of the clevis bracket shown in FIG. 11.

Referring to FIGS. 6A-6B and 9A-9B, the attachment of the frame structure 302 to the support structure at each leg assembly 306 by a clevis mechanism 315 is shown. A clevis bracket 316 is attached to the corner of frame structure 302 (e.g. at the junction/connection of the outer frame members 318) by welding or other suitable fastener arrangement. As shown in FIGS. 9A-9B and 10, clevis mechanism 315 comprises clevis bracket 316 of frame structure 302 and pin 314 secured within a projection 358 within base 320 of leg assembly 306.

Figure 8A:
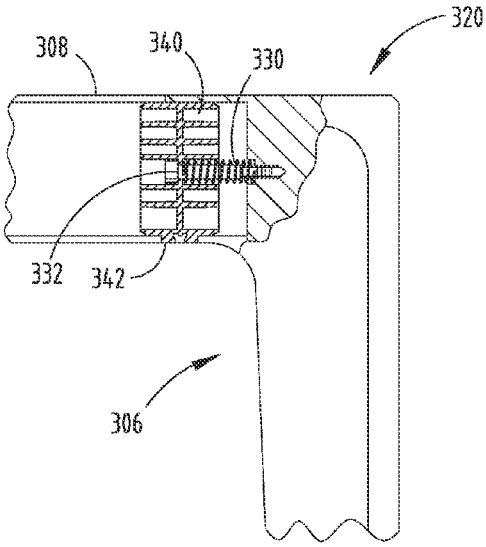
FIG. 8A is a side elevation view showing attachment of a trim member to the leg assembly of the base frame assembly according to an exemplary embodiment.
Figure 8B:
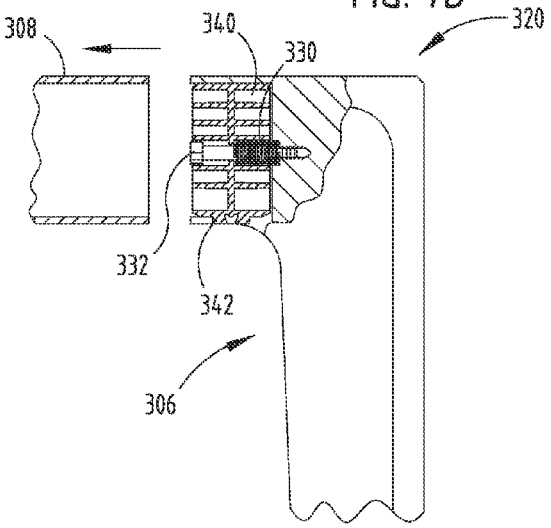
FIG. 8B is a side elevation view showing detachment of the trim member and the leg assembly shown in FIG. 8A.

Referring to FIGS. 8A and 8B, operation of the spring-loaded plunger block 340 of leg assembly 306 is shown. Plunger block 340 provides for the attachment of the trim member 308 to each leg assembly 306 of base 300. As shown in FIGS. 8A and 8B, to attach or detach trim member 308 from leg assembly 306, plunger block 340 is manually (by hand) actuated at a button 342 against the spring force and recessed within a cavity with the base of leg assembly. When button 342 is actuated (e.g. FIG. 8B) and the force of spring 330 is overcome, plunger block 340 will retract within the edge of base 320 of leg assembly 306 and will disengage and release trim member 308. When button 342 is released under the force of spring 330, plunger block 340 will extend beyond the edge of base 320 of leg assembly 306 and into a cavity in trim member 308 to provide an attachment or "lock" of trim member 308 to the leg assembly 306. According to an exemplary embodiment, the profile of the member or plunger can be configured to match the profile of the cavities within the corresponding trim members and base of the leg assembly to provide for suitably secure engagement and suitably free movement.

Referring to FIGS. 10 and 11 through 14, the configuration of clevis bracket 316 of frame structure 302 is shown. At each corner of frame structure 302 formed at the junction of members 318 an attachment point is provided for clevis 316. According to a preferred embodiment, side flanges 356 of clevis 316 are welded to members 318 of frame structure 302 to expose front flanges 352 of clevis 316 for engagement (e.g. attachment to a projection 358) within base 320 of each leg assembly 306 of base 300. As shown in FIG. 10, projection 358 in each base 320 of each leg assembly 306 fits between the flanges 352 of each clevis 316. Pin 314 of each clevis mechanism 315 is inserted through a hole or aperture 354 in each flange 352 of clevis 316 and a corresponding hole 350 in projection 358 in each base 320 of each leg assembly; pin 314 of clevis mechanism 315 is secured into a threaded seat 352 in base 320 of leg assembly 306 to attach frame structure 302 to leg assemblies 306 of the support structure to form base 300 (see also FIGS. 2B, 3B, 6B and 9B).

Figure 15:
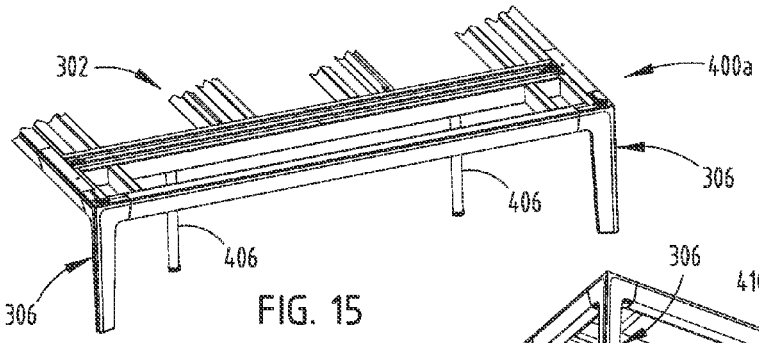
FIG. 15 is a fragmentary top perspective view of a supplemental frame assembly for the base frame assembly according to an exemplary embodiment.
Figure 16:
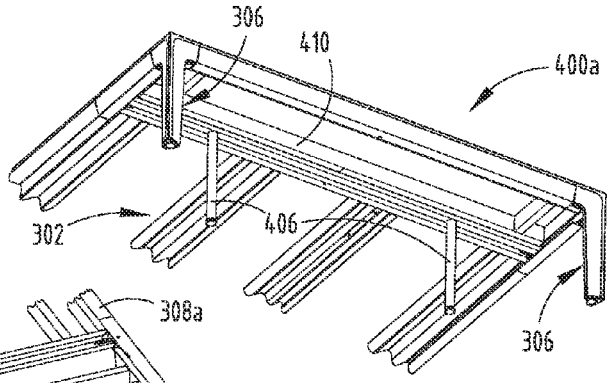
FIG. 16 is a bottom perspective view of the supplemental frame assembly shown in FIG. 15.
Figure 17:
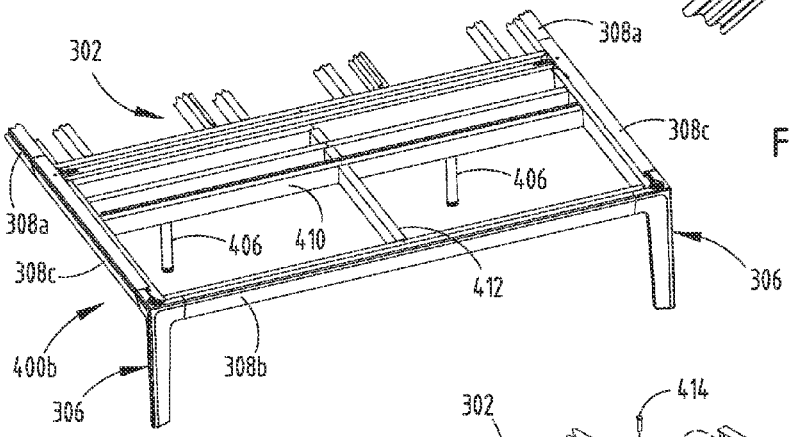
FIG. 17 is a fragmentary top perspective view of a supplemental frame assembly for the base frame assembly according to an exemplary embodiment.
Figure 18:
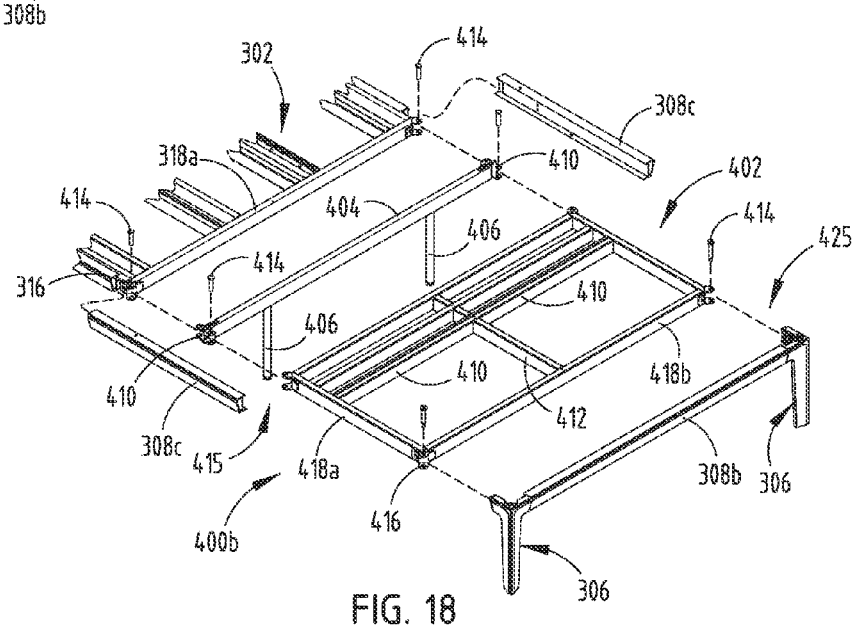
FIG. 18 is an exploded perspective view of the supplemental frame assembly shown in FIG. 17.

According to any preferred embodiment, the base (or standard bases) will have a standard size and configuration to construct articles of furniture from modular components. As shown in FIGS. 15 through 18, to extend the size of the base a supplemental frame 400*a* or 400*b* may be provided for the article of furniture. Attachment of supplemental frame 400 to frame structure 302 and within the support structure will allow the enlargement of base 300 for configuration and construction of articles of furniture having a larger size (than on the standard base). According to an exemplary embodiment, use of a supplemental frame 400 (which as shown is available in multiple sizes, compare FIGS. 16 and 17) for attachment to the frame structure 302 allows for various articles of furniture within the set to be constructed in various multiple sizes and configurations supporting various combinations of modules and components of additional various types and sizes. See FIGS. 1A and 1B. As shown in FIGS. 15 and 16, a supplemental frame assembly 400*a* is provided in a first size; as shown in FIGS. 17 and 18, a supplemental frame assembly 400*b* is provided in a second size (larger than the first size of supplemental frame assembly 400*a*).

As shown in FIG. 18, supplemental frame assembly 400*b* comprises a frame structure 402 with inner frame members 410 and 412 and outer frame members 418*a* and 418*b*; inner frame members 410 are oriented transverse to inner frame members 412. The supplemental frame assembly also comprises a leg frame 404 with legs shown as posts 406.

Referring to FIGS. 17 and 18, frame structure 402 of the supplemental frame assembly comprises clevis brackets 416 at each corner (e.g. at the junction of outer frame members 418); the leg frame 404 of the supplemental frame assembly comprises at each end a bracket 410. Frame structure 402 of the supplemental frame assembly is attached to the support structure of the base by a clevis arrangement 425 employing clevis brackets 416 with fasteners shown as pins 414 in engagement with leg assembly 306 (similar to as shown for clevis arrangement 315 in FIG. 10). As shown in FIGS. 18 and 20A through 20C, bracket 410 of leg frame 404 is configured to provide a dual clevis arrangement 415: Frame structure 402 of the supplemental frame assembly is attached to leg frame 404 by one portion of dual clevis arrangement 415 employing clevis brackets 416 with fasteners shown as pins 414 in engagement with bracket 410; leg frame 404 of the supplemental frame assembly is attached to the frame structure of the base by one portion of dual clevis arrangement 415 employing clevis brackets 315 with fasteners shown as pins 414 in engagement with bracket 410. The supplemental frame assembly also comprises a trim member 308*c* configured for attachment to leg assembly 306 and trim member 308*a* of the base.

Figure 19A:
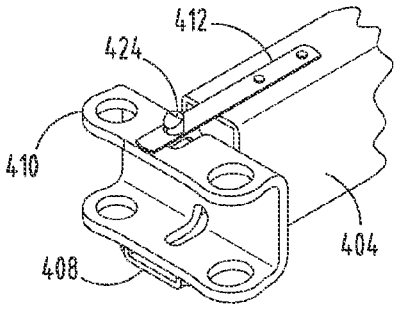
FIG. 19A is a fragmentary top perspective view of a leg frame with bracket for the supplemental frame assembly according to an exemplary embodiment.
Figure 19B:
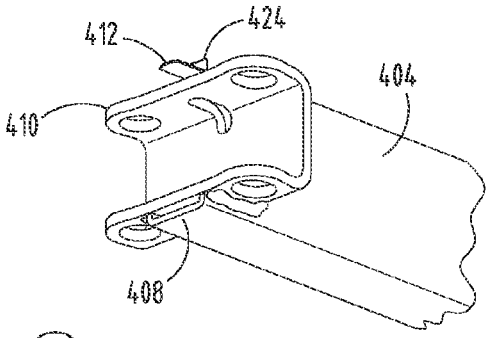
FIG. 19B is a fragmentary bottom perspective view of the leg frame with bracket shown in FIG. 19A.

In FIGS. 19A and 19B, the configuration of bracket 410 providing dual clevis arrangement 415 for attachment of leg frame 404 of the supplemental frame assembly is shown according to an exemplary embodiment. As shown, bracket 410 is attached (e.g. joined by welding) to a projection shown as support flange 408 on leg frame 404 and by a member shown as mounting tab 412 (e.g. attached by rivets) at the top of leg frame 404. Mounting tab 412 provides an upright pin or post 424 at the top of bracket 410.

Figure 20A:
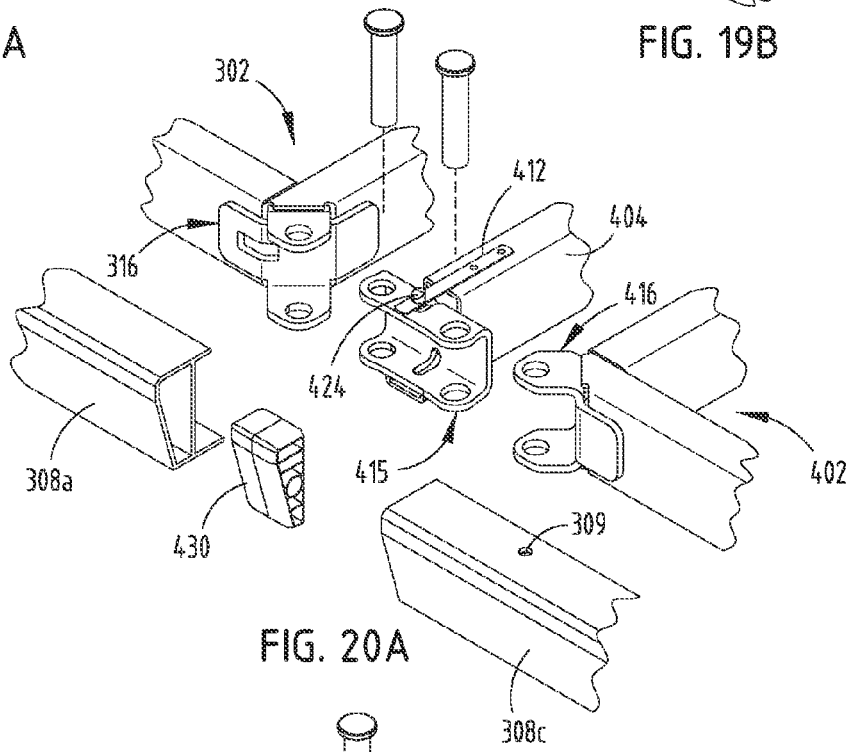
FIG. 20A is an exploded perspective view of attachment of the supplemental frame assembly to the frame structure for the base frame assembly according to an exemplary embodiment.
Figure 20B:
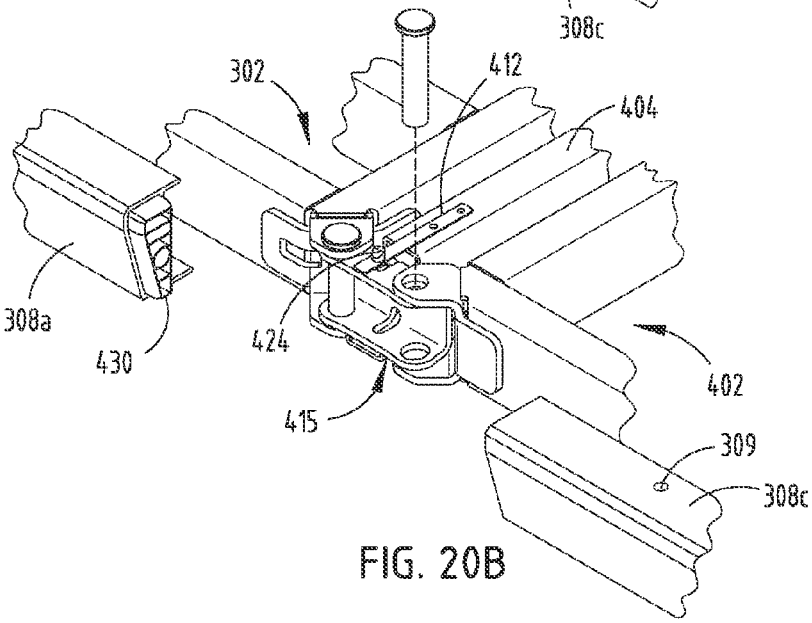
FIG. 20B is a partially exploded perspective view of the attachment of the supplemental frame assembly to the frame structure shown in FIG. 20A.
Figure 20C:
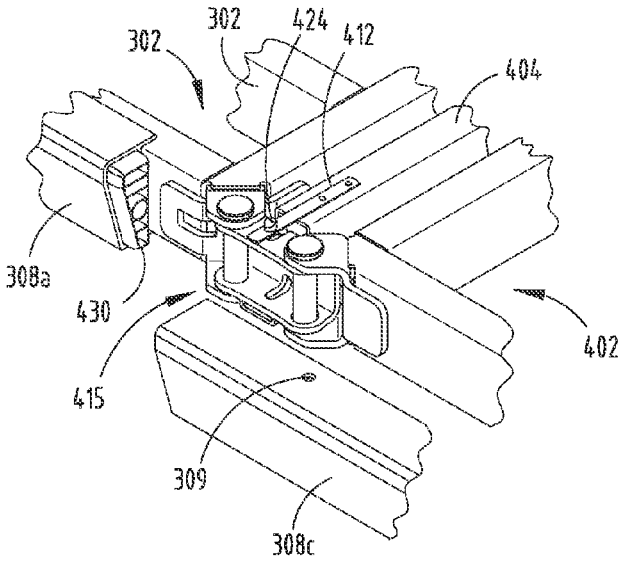
FIG. 20C is a partially exploded perspective view of the attachment of the supplemental frame assembly to the frame structure shown in FIG. 20A.
Figure 21A:
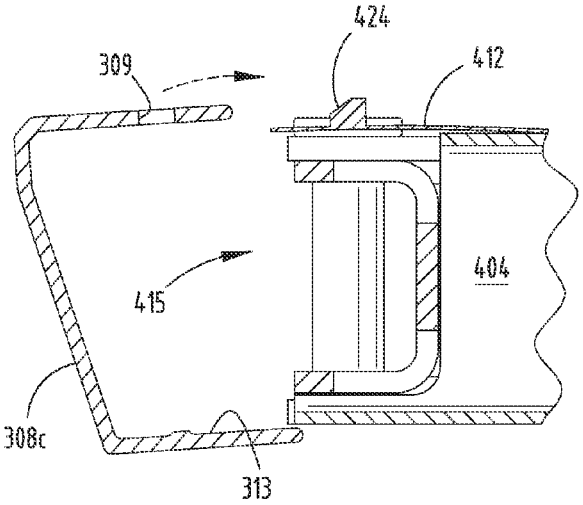
FIG. 21A is a cross-sectional elevation view of a trim member to be attached to the supplemental frame assembly according to an exemplary embodiment.
Figure 21B:
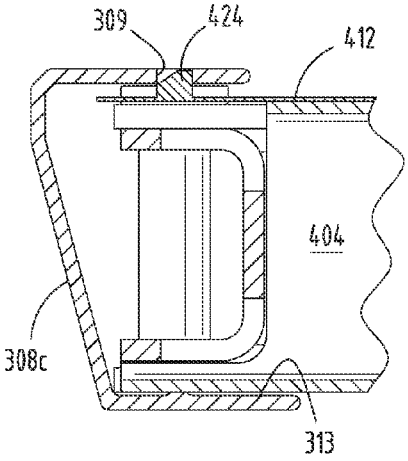
FIG. 21B is a cross-sectional elevation view of the attachment of the trim member to the supplemental frame assembly shown in FIG. 21A.

Referring to FIGS. 20A through 20C, trim members 308*a* and 308*c* are coupled together by a member shown as joining block 430 that fits securely within a cavity at the joining end of each trim member 308*a* and 308*c*. As shown in FIGS. 21A and 21B, trim member 308*c* of the supplemental frame assembly has top flange with an aperture 309 and bottom flange with a rib 313; when trim member 308*c* is installed, aperture 309 of top flange fits onto post 424 of bracket 410 and rib 313 of bottom flange engages the support 406 beneath leg frame 404 (e.g. by a friction-assisted or interference fit) acting to hold trim member 308*c* in a secure position (also covering clevis arrangement 415). (Note that in the FIGURES, such as FIGS. 15-17 and 21B, for clarity the attachment of the trim member to the base is shown prior to the installation of modules or components to the base; according to any preferred embodiment, the trim members are attached to the base after the installation of the modules or components that are secured to the base by the trim members.)

Figure 22A:
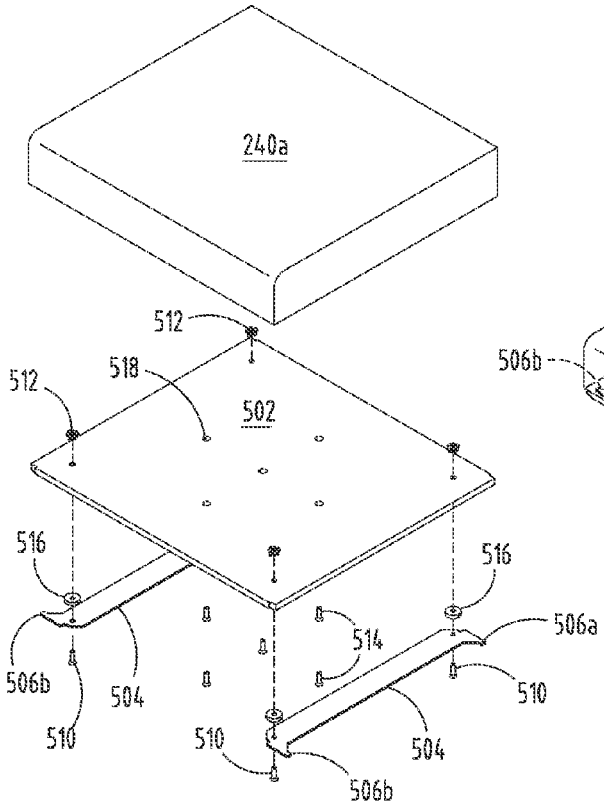
FIG. 22A is an exploded perspective view of a module or component shown as a seat cushion assembly for attachment to the base frame assembly of the article of furniture according to an exemplary embodiment.
Figure 22B:
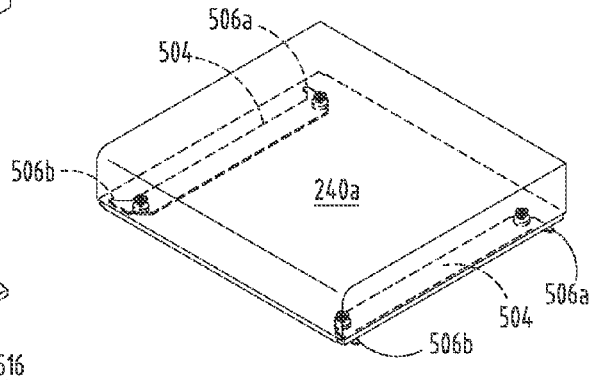
FIG. 22B is a perspective view of the module or component shown as a seat cushion assembly in FIG. 22A.

Referring to FIGS. 22A and 22B, the configuration for a representative module or component shown as seat cushion 240*a* to be attached to the base of the article of furniture is shown according to an exemplary embodiment. A base panel 502 is provided for attachment beneath seat cushion 240*a* and for attachment to a set of mounting brackets 504. Base panel 502 is attached to mounting brackets 504 by fasteners shown as bolts 510 separated by spacers 516 (providing a gap between the mounting bracket and the bottom of the base panel) and capped by a threaded cap or nut 512; base panel 502 is attached to seat cushion 240*a* by fasteners shown as bolts or screws 514. Mounting brackets 504 for a module or component have flanges or tabs 506*a* and 506*b* that extend as projections and provide attachment points for the module or component to the base or base frame assembly. In FIG. 22B, the module or component shown as a seating unit providing a seat cushion assembly is shown configured for attachment to the base of the article of furniture.

Figure 23:
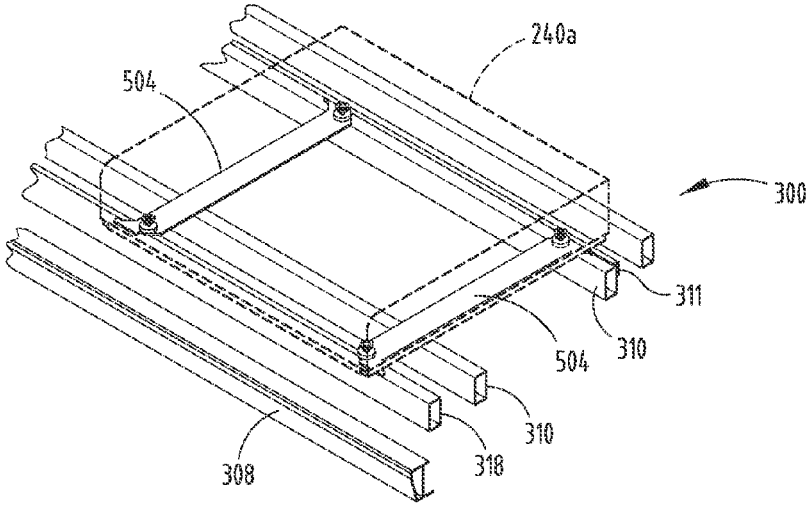
FIG. 23 is a perspective view of attachment of a module or component shown as a seat cushion assembly to the base frame assembly according to an exemplary embodiment.
Figure 24A:
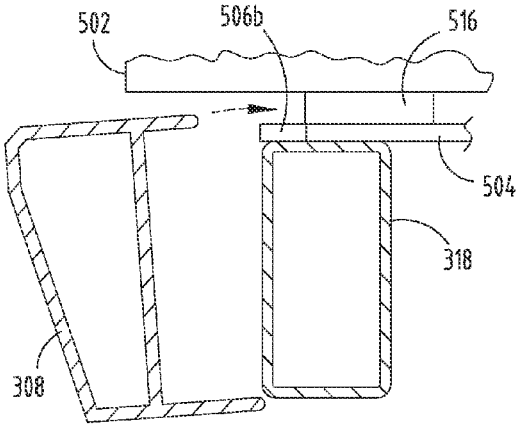
FIG. 24A is cross-sectional elevation view of attaching of a module or component to the base frame assembly according to an exemplary embodiment.
Figure 24B:
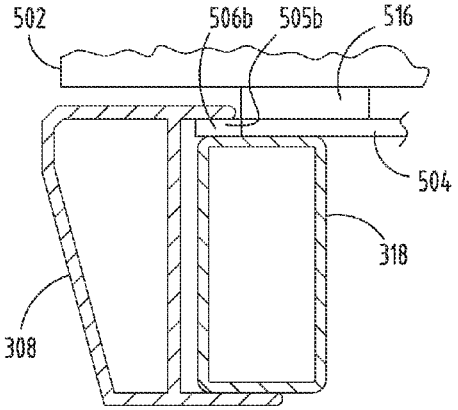
FIG. 24B is cross-sectional elevation view of attachment of the module or component to the base frame assembly shown in FIG. 24A.
Figure 24C:
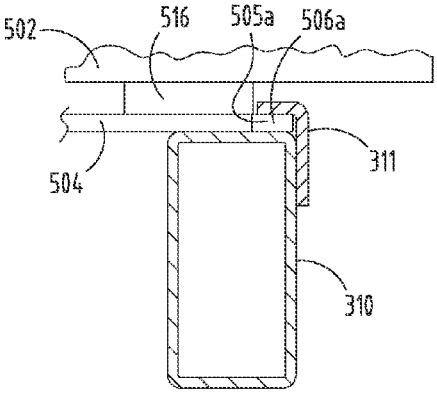
FIG. 24C is cross-sectional elevation view of attachment of a module or component to the base frame assembly according to an exemplary embodiment.
Figure 25:
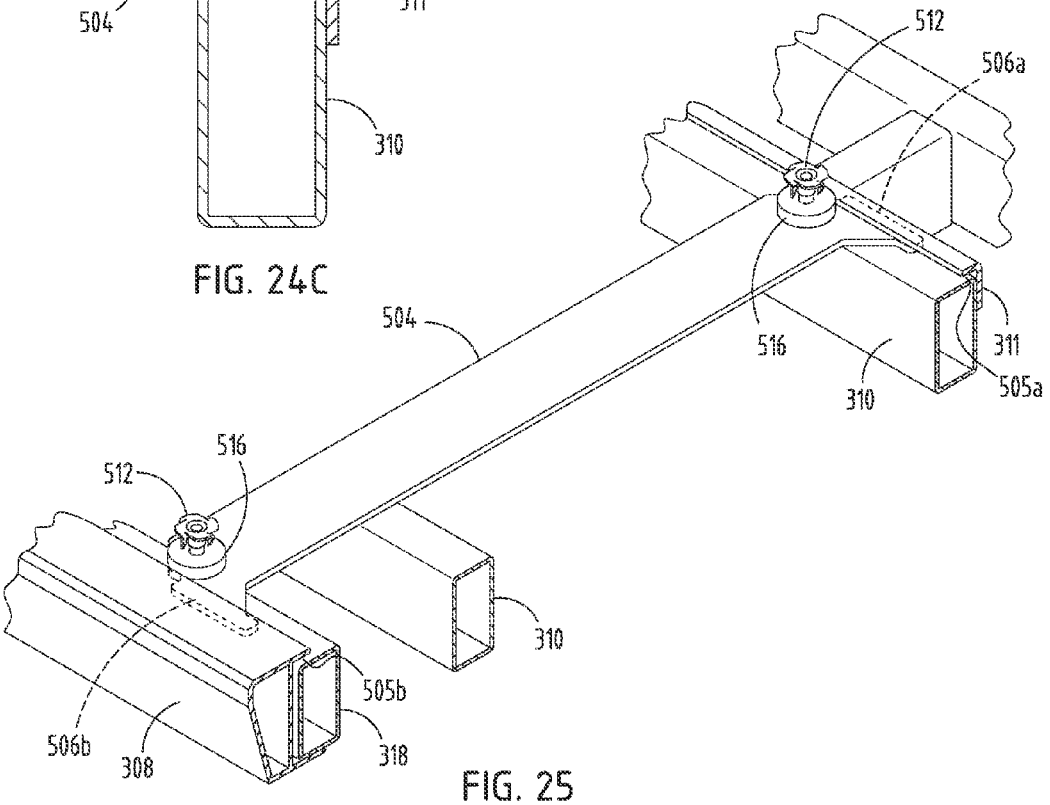
FIG. 25 is perspective view of attachment of a module or component to the base frame assembly according to an exemplary embodiment.

Attachment of a representative module or component to the base of the article of furniture is shown according to an exemplary embodiment in FIG. 23. As shown, modules or components are supported on the frame structure of the base; a module or component is supported across the frame members of the base (e.g. spanning an inner frame member 310 and an outer frame member 318). As shown in FIGS. 23 through 25, according to an exemplary embodiment, attachment of modules or components to the base frame assembly is provided by engagement of the mounting bracket on the module/component with corresponding frame members and trim members. As shown in FIGS. 24C and 25, a member shown as an angle iron 311 is attached (e.g. by welding or mechanical fasteners) to an inner frame member 310 of the frame structure 302 of the base; a gap shown as channel 505*a* is formed between the upper surface of inner frame member 310 and the bottom surface of the flange of member 311. Tab 506*a* at one end of mounting bracket 504 is inserted into channel 505 formed between member 310 and member 311 to secure the corresponding end of the module or component to the base; tab 506*b* at the other end of mounting bracket 504 extends over member 318 freely until secured and covered by installation of trim member 308 to the base (as shown in FIGS. 24A, 24B and 25). Installation of trim member 308 forms a channel 505*b* between the upper surface of frame member 318 and the bottom surface of a top flange of trim member 308; tab 506*b* of mounting bracket 504 when beneath the top flange of trim member 308 is secured within channel 505*b* and the corresponding end of the module or component is secured to the base.

Figure 26A:
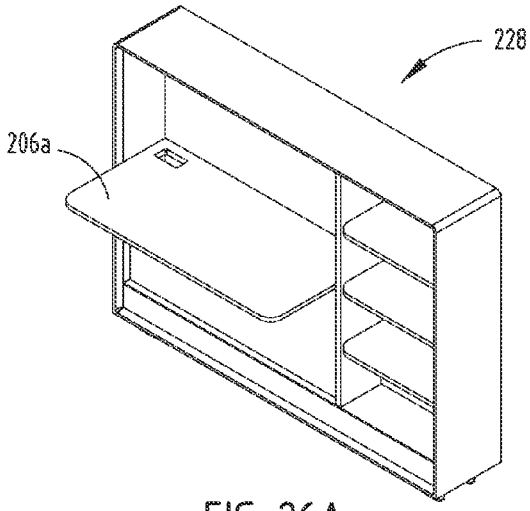
FIG. 26A is a top perspective view of a module or component shown as a casegood unit for attachment to the base frame assembly according to an exemplary embodiment.
Figure 26B:
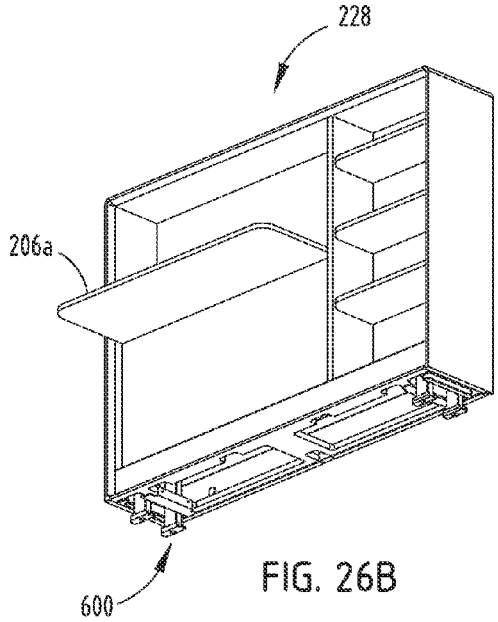
FIG. 26B is a bottom perspective view of the module or component shown as a casegood unit shown in FIG. 26A.
Figure 26C:
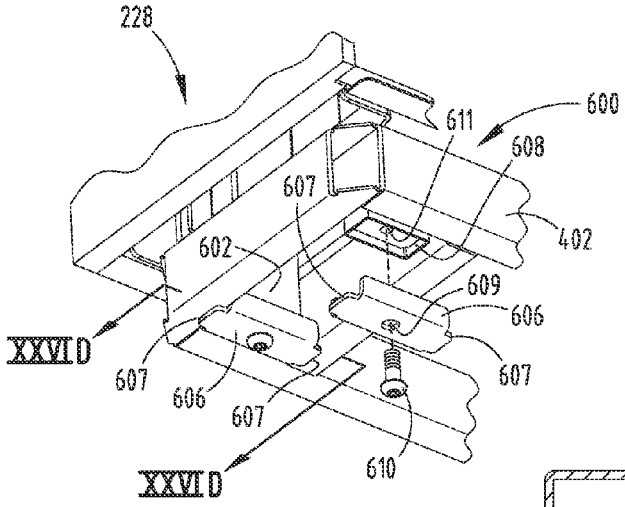
FIG. 26C is a bottom perspective view of the attachment of a module or component to the base frame assembly according to an exemplary embodiment.
Figure 26D:
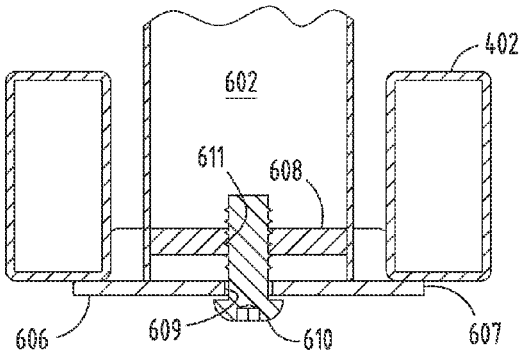
FIG. 26D is a cross-sectional elevation view of the attachment of the module or component to the base frame assembly shown in FIG. 26C.

Referring to FIGS. 26A through 26D, attachment of the representative module or component to the base of the article of furniture is shown according to another exemplary embodiment. A module or component is shown as a casegood unit 228 providing a worksurface 206*a* and shelving/storage 212*a*; module 228 has a base 600 configured to facilitate secure attachment to the base of the article of furniture. As shown in FIGS. 26B and 26C, base 600 provides a set of mounting arrangements for the module or component to be secured to a frame 402 of the base (e.g. as shown, between the members of frame structure of the supplemental frame assembly of the base). Base 600 provides a set of posts or bayonets 602 that project through a space between members of frame structure 402. Brackets shown as clips 606 with flanges or tabs 607 are attached to the bottom of posts 602 by fasteners shown as bolts 610 inserted through apertures 609 of clips 606 and secured (e.g. by threaded connection) into apertures 611 in a plate 608 within the bottom of posts 602. As shown in FIG. 26D, attachment of clips 606 to posts 602 by tightening of bolt 610 into aperture 611 brings tabs 607 of clips 606 into secure (tightened) engagement with the members of frame 402 and holds base 600 of the associated module or component (shown as casegood unit 228) securely to the base of the article of furniture.

It is important to note that the construction and arrangement of the elements of the inventions as described in system and method and as shown in the figures above is illustrative only. Although some embodiments of the present inventions have been described in detail in this disclosure, those skilled in the art who review this disclosure will readily appreciate that many modifications are possible without materially departing from the novel teachings and advantages of the subject matter recited. Accordingly, all such modifications are intended to be included within the scope of the present inventions. Other substitutions, modifications, changes and omissions may be made in the design, variations in the arrangement or sequence of process/method steps, operating conditions and arrangement of the preferred and other exemplary embodiments without departing from the spirit of the present inventions.

It is important to note that the system and method of the present inventions can comprise conventional technology or any other applicable technology (present or future) that has the capability to perform the functions and processes/operations indicated in the FIGURES. All such technology is considered to be within the scope of the present inventions.

The invention claimed is:

1. An article of furniture having a modular constriction comprising:

a base comprising a unitary frame structure;

a seating component comprising a backrest, the seating component supported on the base; and a casegood component providing for storage of items and comprising a back side, the casegood component supported on the base;

wherein the seating component is mounted to the base in a first orientation and the casegood component is mounted to the base in a second orientation, wherein the first orientation is transverse to the second orientation; and wherein the seating component backrest abuts a midpoint of the casegood component back side.

2. The article of claim 1 wherein the casegood component comprises at least one of a storage unit, a cabinet, a shelving unit.

3. The article of claim 1 wherein the base further comprises a supplemental frame attachable to the frame structure and wherein the supplemental frame is configured to support at least one modular component.

4. The article of claim 1 further comprising at least one trim member configured for attachment to the unitary frame structure and to secure at least one component to the base.

5. The article of claim 2, wherein a vertical height of the casegood component is greater than a vertical height of the backrest.

6. The article of claim 5 further comprising at least one trim member configured for attachment to the unitary frame structure and to secure at least one component to the base.

7. The article of claim 3 wherein the casegood component comprises at least one of a storage unit, a cabinet, a shelving unit.

8. The article of claim 7, wherein a vertical height the casegood component is greater than a vertical height of the backrest.

9. An article of furniture having a modular construction comprising:

a base comprising a unitary frame structure;

a first seating component comprising a first seat cushion supported on the base;

a second seating component comprising a second seat cushion supported on the base; and a casegood component providing for storage of items and comprising a back side, the casegood component supported on the base;

wherein the first and second seating components share a backrest; and wherein the first seat cushion is mounted to the base in a first orientation, the second seat cushion is mounted to the base in a second orientation and the casegood component is mounted to the base in a third orientation, wherein the first and second orientations are transverse to the third orientation.

10. The article of claim 9 wherein the backrest abuts the casegood component back side.

11. The article of claim 10, wherein the first orientation is opposite the second orientation.

12. The article of claim 10 wherein the casegood component comprises at least one of a storage unit, a cabinet, a shelving unit.

13. The article of claim 12 wherein the base further comprises a supplemental frame attachable to the frame structure and wherein the supplemental frame is configured to support at least one modular component.

14. The article of claim 9, wherein a vertical height of the casegood component is greater than a vertical height of the backrest.

15. The article of claim 14 wherein the backrest abuts a midpoint of the casegood component back side.

16. An article of furniture having a modular construction comprising:

a base comprising a unitary frame structure;

a first seating component comprising a first seat cushion supported on the base;

a second seating component comprising a second seat cushion supported on the base; and a casegood component comprising a backside and comprising at least one of a storage unit, a cabinet, a shelving unit, the casegood component supported on the base;

wherein the first and second seating components share a backrest;

wherein the backrest abuts the casegood component back side;

wherein a vertical height of the casegood component is greater than a vertical height of the backrest; and wherein the first seat cushion is mounted to the base in a first orientation, the second seat cushion is mounted to the base in a second orientation and the casegood component is mounted to the base in a third orientation, wherein the first and second orientations are transverse to the third orientation.

17. The article of claim 16 wherein the base further comprises a supplemental frame attachable to the flame structure and wherein the supplemental frame is configured to support at least one modular component.

18. The article of claim 17, wherein the first orientation is opposite the second orientation.

19. The article of claim 18 further comprising at least one trim member configured for attachment to the unitary frame structure and to secure at least one component to the base.

* * * * *